US010184491B2

(12) United States Patent
Ebert et al.

(10) Patent No.: US 10,184,491 B2
(45) Date of Patent: Jan. 22, 2019

(54) SUCTION DEVICE WITH SOUND MIRROR DEVICE

(71) Applicant: Alfred Kärcher GmbH & Co. KG, Winnenden (DE)

(72) Inventors: Florian Ebert, Kernen (DE); Felix Bensing, Stuttgart (DE); Sebastian Junker, Stuttgart (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 306 days.

(21) Appl. No.: 15/079,292

(22) Filed: Mar. 24, 2016

(65) Prior Publication Data

US 2016/0201691 A1 Jul. 14, 2016

Related U.S. Application Data

(63) Continuation of application No. PCT/EP2013/070098, filed on Sep. 26, 2013.

(51) Int. Cl.

| | |
|---|---|
| ***F04D 29/66*** | (2006.01) |
| ***F04D 17/16*** | (2006.01) |
| ***F04D 25/06*** | (2006.01) |
| ***F04D 29/44*** | (2006.01) |
| ***A47L 9/00*** | (2006.01) |
| ***F04D 29/42*** | (2006.01) |

(52) U.S. Cl.

CPC ..... *F04D 29/665* (2013.01); *A47L 9/0081* (2013.01); *F04D 17/16* (2013.01); *F04D 25/06* (2013.01); *F04D 29/422* (2013.01); *F04D 29/441* (2013.01); *F04D 29/663* (2013.01); *F04D 29/664* (2013.01)

(58) Field of Classification Search

CPC ..... A47L 9/0081; F04D 17/16; F04D 25/06; F04D 29/422; F04D 29/441; F04D 29/663; F04D 29/664; F04D 29/665

See application file for complete search history.

(56) References Cited

U.S. PATENT DOCUMENTS

| | | | | |
|---|---|---|---|---|
| 3,676,012 | A * | 7/1972 | Brockie | F04D 29/664 181/227 |
| 4,195,969 | A | 4/1980 | Whitney | |
| 5,007,499 | A | 4/1991 | Ebbing et al. | |
| 5,067,584 | A | 11/1991 | Williams et al. | |
| 6,003,200 | A | 12/1999 | Potts et al. | |
| 6,733,236 | B2 * | 5/2004 | Sumser | F01D 9/06 138/39 |

(Continued)

FOREIGN PATENT DOCUMENTS

| | | |
|---|---|---|
| DE | 603 04 308 | 11/2006 |
| EP | 1 403 105 | 3/2004 |

(Continued)

*Primary Examiner* — William McCalister

(74) *Attorney, Agent, or Firm* — Womble Bond Dickinson (US) LLP

(57) ABSTRACT

A suction device is provided which includes a fan device for generating a suction air flow and an air conveying device having at least one flow deflection element comprising an inlet tube and an outlet tube, wherein the outlet tube is oriented transversely to the inlet tube, and wherein in a transitional area between the inlet tube and the outlet tube there is arranged a sound mirror device, which at least one of (i) reflects and (ii) absorbs sound.

23 Claims, 6 Drawing Sheets

(56) References Cited

U.S. PATENT DOCUMENTS

| | | | | |
|---|---|---|---|---|
| 6,918,740 | B2 * | 7/2005 | Liu | F04D 29/665 415/1 |
| 8,276,398 | B2 * | 10/2012 | Grabon | F25B 43/02 62/296 |
| 8,943,644 | B2 | 2/2015 | Andersson et al. | |

FOREIGN PATENT DOCUMENTS

| | | |
|---|---|---|
| JP | 2008-200480 | 9/2008 |
| JP | 2009 100840 | 5/2009 |
| KR | 2008 0070546 | 7/2008 |
| RU | 2 429 386 | 9/2011 |
| RU | 2 454 573 | 6/2012 |
| WO | WO 2010/071534 | 6/2010 |

* cited by examiner

SUCTION DEVICE WITH SOUND MIRROR DEVICE

This application is a continuation of international application number PCT/EP2013/070098 filed on Sep. 26, 2013, which is incorporated herein by reference in its entirety and for all purposes.

BACKGROUND OF THE INVENTION

The invention relates to a suction device comprising a fan device for generating a suction air flow and an air conveying device having at least one flow deflection element comprising an inlet tube and an outlet tube.

By way of example, exhaust air is discharged via the flow deflection element. Here, the exhaust air may be suction exhaust air and/or cooling exhaust air. Feed air can also be fed via the flow deflection element.

A vacuum cleaner which comprises a suction head is known from U.S. Pat. No. 4,195,969. The suction head has a base and at least one fan motor, which is arranged on the base and has an exhaust air outlet. The exhaust air outlet is connected to a sound chamber, in which there is positioned a plurality of absorbing elements.

SUMMARY OF THE INVENTION

In accordance with the present invention, a suction device is provided, which reduces noise with low pressure loss in the air conveying device.

In accordance with an embodiment of the invention, in a transitional area between the inlet tube and the outlet tube there is arranged a sound mirror device, which reflects and/or absorbs sound.

Air flows through the flow deflection element, wherein this flow is deflected at the flow deflection element.

Due to the provision of the sound mirror device, at least some of the sound waves are reflected within the flow deflection element. At least some of the corresponding sound waves then cannot propagate through an outlet of the outlet tube, and a noise reduction is achieved accordingly.

The inlet at the inlet tube and the outlet at the outlet tube correspond here to the sound propagation, i.e. sound enters the inlet tube and exits from the outlet tube. It is possible that a fluid flow likewise enters the inlet tube and exits from the outlet tube. It is also possible, however, that a fluid flow enters the outlet tube and exits from the inlet tube.

The sound mirror device can be provided in a simple manner by appropriate wall structure design. It can be formed in particular such that the flow is not influenced or is only influenced to a minimal extent.

In particular, the sound mirror device has a wall structure that reflects sound.

The wall structure is preferably oriented here such that a reflection direction is oriented toward the inlet of the inlet tube, and/or the wall structure is preferably oriented such that a multiple sound reflection occurs within the at least one flow deflection element. A noise reduction is then achieved.

In one exemplary embodiment the wall structure has a first wall arranged opposite the inlet. Sound waves in the direction of the first wall can thus be reflected. The proportion of sound waves that can propagate through an outlet of the outlet tube is thus reduced and a noise reduction is attained.

In one exemplary embodiment a trough is formed in the transitional area by means of the first wall. Within the flow deflection element the trough forms a recess opposite the inlet. A "sound trough" is thus formed, in order to achieve an effective sound reduction. The sound trough may have one or more straight or curved delimiting walls.

In one embodiment the first wall is formed at least approximately flat, in order to obtain a back reflection in the direction of the inlet in an effective manner.

Here, it is also favorable if the first wall is oriented parallel to an inlet opening of an inlet or is oriented at a small acute angle less than 30° relative to the inlet opening. An effective back reflection toward the inlet can thus be achieved. If the first wall is oriented at a small acute angle to the inlet opening, a sound trough device can be provided. In particular, a multiple reflection of sound waves within the flow deflection element can thus be achieved in order to attain an effective noise reduction.

It is favorable for the same reason if the first wall is oriented transversely to an outlet opening of an outlet. The proportion of sound waves that can propagate to the outlet is minimized as a result.

For this reason, it is favorable if the first wall lies parallel or at an obtuse angle of at least 150° to the outlet tube.

It is also advantageous if the wall structure comprises a second wall, which is oriented transversely to the first wall and adjoins the first wall toward an inlet of the inlet tube and in particular joins in a manner forming an edge. By way of example, a sound reflection may likewise occur at the second wall, in particular when multiple reflections are present.

In particular, the second wall is a continuation of the inlet tube toward the first wall. The second wall is formed in particular such that the sound propagation of reflected sound to the inlet is minimally disrupted.

It may be advantageous if the second wall is at least approximately flat, in particular in order to provide an effective sound mirror design.

It is more particularly advantageous if the wall structure has a third wall, which is arranged opposite the first wall and connects the inlet tube to the outlet tube, wherein the third wall is curved. The third wall is significant for the flow guidance. Due to a curved design, a pressure loss caused by the flow deflection can be kept low. Furthermore, sound waves which are reflected in particular by the first wall can also be reflected at the third wall in order to achieve an effective noise reduction.

It is more particularly advantageous if an inner radius of the third wall is greater than half the hydraulic diameter of the inlet tube. A flow deflection with minimized pressure loss is thus provided. A flow deflection with minimized pressure loss can thus be achieved with great acoustic efficacy in respect of the noise reduction.

In one exemplary embodiment a cross-sectional area (perpendicular to the flow direction through the cross-sectional area) of the at least one flow element is greater at the sound mirror device than at an inlet and/or at an outlet. An effective mirror surface for the sound reflection is thus provided, wherein this can be achieved in particular without excessively influencing the flow.

By way of example, a cross-sectional area of the inlet tube then increases from an inlet toward the sound mirror device and in particular increases monotonically. A high level of reflection for sound waves thus can be achieved. For the same reason it is favorable if a cross-sectional area of the outlet tube decreases away from the sound mirror device toward an outlet and in particular decreases monotonically.

The inlet tube has a first central longitudinal axis and the outlet tube has a second central longitudinal axis, wherein the first central longitudinal axis and the second central longitudinal axis intersect one another at a point of intersection, which lies in the transitional area within the at least one flow deflection element. An effective flow deflection with low pressure loss can thus be achieved, wherein a good level of reflection for sound waves and therefore an effective noise reduction can also be achieved at the same time.

It is more particularly advantageous if the point of intersection lies between an inlet and a first wall of the sound mirror device. An effective flow deflection with low pressure loss is thus achieved and a high level of reflection for sound waves is achieved at the first wall.

For the same reason it is favorable if the point of intersection lies between a second wall of the sound mirror device and an outlet. The second wall of the sound mirror device lies here in particular transversely to the first wall.

The first central longitudinal axis and the second central longitudinal axis are advantageously oriented at an angle of at least 30° to one another.

In particular, the angle lies in the range between 80° and 100°, and for example is approximately 90°.

It may be that on the sound mirror device, in particular when this is formed as a sound trough device, there is arranged a sound-permeable flow guiding device. Here, the flow guiding device in particular has elements which guide the flow and are not flow-permeable themselves. An increased effective flow guidance and in particular deflection can then be implemented, wherein the sound reflection properties are maintained.

In one exemplary embodiment the at least one flow deflection element is part of a bend. The air conducting device can thus be formed in an effective manner and with simple manufacture.

In particular, the bend here may surround a fan of the fan device at least in part. A space-saving construction is thus provided, wherein flow paths are minimized.

The air conveying device is favorably fluidically connected to the fan device. Suction exhaust air can then be discharged via the air conducting device. However, it is also possible in principle that the air conducting device by way of example is part of a cooling air guide of the suction device.

The air conveying device in particular is designed for the discharge of suction air and/or for the feed of suction air and/or is designed for the discharge of cooling air and/or for the feed of cooling air.

The suction device is formed for example as a dry vacuum cleaner, or as a wet vacuum cleaner, or as a wet-dry vacuum cleaner, or as a spray extraction appliance, wherein the suction device may be an independent appliance ("stand-alone appliance") or may be part of a cleaning machine. By way of example, the suction device is part of a manually moved or self-driving cleaning machine, such as a floor cleaning machine and for example a sweeping machine or scrubbing machine.

In particular, an outlet of the outlet tube of the at least one flow deflection element is arranged on a housing of the suction device or is fluidically connected to a housing outlet. A simple construction with minimized flow losses is thus provided.

The following description of preferred embodiments serves in conjunction with the drawings to explain the invention in greater detail.

DETAILED DESCRIPTION OF THE INVENTION

Figure 1:
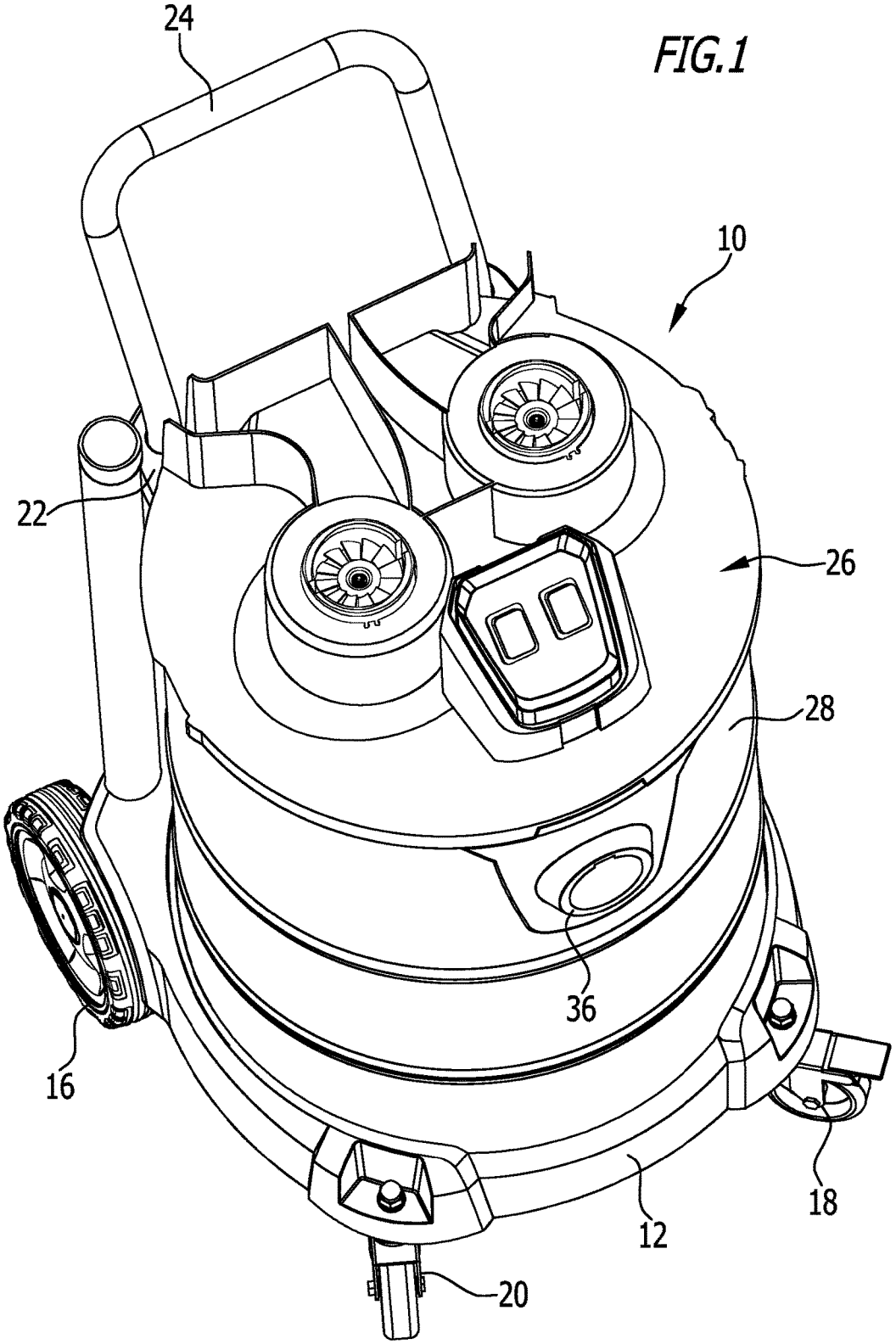
FIG. 1 shows a perspective illustration of an exemplary embodiment of a suction device as wet-dry vacuum cleaner in the form of a spray extraction appliance.
Figure 2:
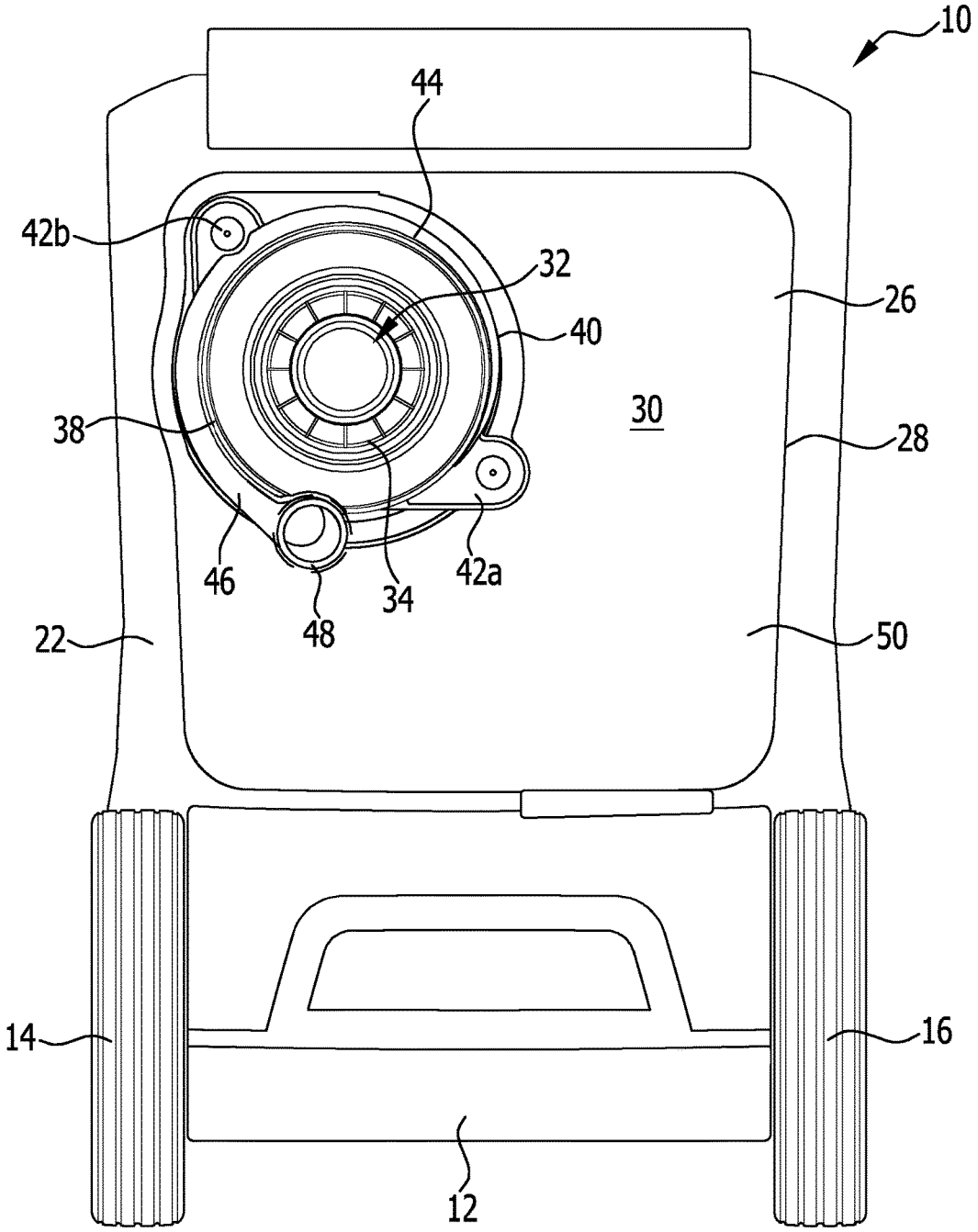
FIG. 2 shows a rear view of the suction device according to FIG. 1 with opened housing, wherein a fan device is shown.

An exemplary embodiment of a suction device which is shown in FIGS. 1 and 2 and is designated there by 10 is a vacuum cleaner having a base 12. The base 12 is movable and has a left rear wheel 14 and a right rear wheel 16. Furthermore, a left front castor 18 and a right front castor 20 are arranged on the base. The left front castor 18 and the right front castor 20 are positioned pivotally on the base 12.

A handle unit 22 with a handgrip 24, by means of which in particular the suction device 10 as a whole can be pushed and pulled, also sits on the base 12.

A suction body 26 is positioned on the base 12 and is positioned here removably in particular. The suction body 26 has a housing 28, in the interior 30 of which (see FIG. 2) components of the suction device 10 are arranged.

The suction device 10 comprises a fan device 32 (FIG. 2), which has a fan 34 and an associated motor, for example an electric motor, which drives one or more impellers of the fan 34.

A suction air flow can be generated by means of the fan device 32.

A connector 36 is arranged on the housing 28, which connector can be adjoined by a suction hose or a suction tube. This connector 36 is fluidically connected to the fan device 32.

Components, such as a dirt collection container and the like, are arranged in the interior 30 of the housing 28.

In one exemplary embodiment the suction device 10 is formed as a spray extraction appliance, by means of which liquid can be sprayed onto a surface to be cleaned and excess liquid can be sucked away.

Corresponding components, in particular such as a tank for fresh water and where appropriate one or more tanks for chemical additives, are then arranged in the interior 30. Furthermore, a device is arranged in the interior 30 for conveying cleaning fluid correspondingly for application to the surface.

Exhaust air is produced during operation of the suction device 10. This exhaust air is discharged via an exhaust air discharge device as part of an air conveying device 38.

Corresponding suction exhaust air is produced during suction operation of the suction device 10.

In principle, cool exhaust air is produced with a cooling of the fan device 32 and/or of further components of the suction device 10.

In one exemplary embodiment the air conveying device 38 for the fan device 32 comprises a bend 40. The bend 40 is in particular fixed in the interior 30. For this purpose, it has mounting tabs 42*a*, 42*b* by way of example, by means of which it is fixed. Exhaust air of the fan device 32 is coupled into the bend 40 and coupled out therefrom. The bend is annular for example and comprises an annular channel 44, which surrounds the fan 34.

On the bend 40 there is arranged a flow deflection element 46, which is formed such that exhaust air can be delivered to the surrounding environment via a corresponding housing outlet.

In the case of the suction device 10, the housing outlet, which is indicated in FIG. 2 by 48, is arranged on a rear side 50 of the housing 28, which lies near the rear wheels 16, 18.

The flow deflection element 46 is designed such that it is noise-reducing and the sound wave propagation is influenced accordingly.

Figure 3:
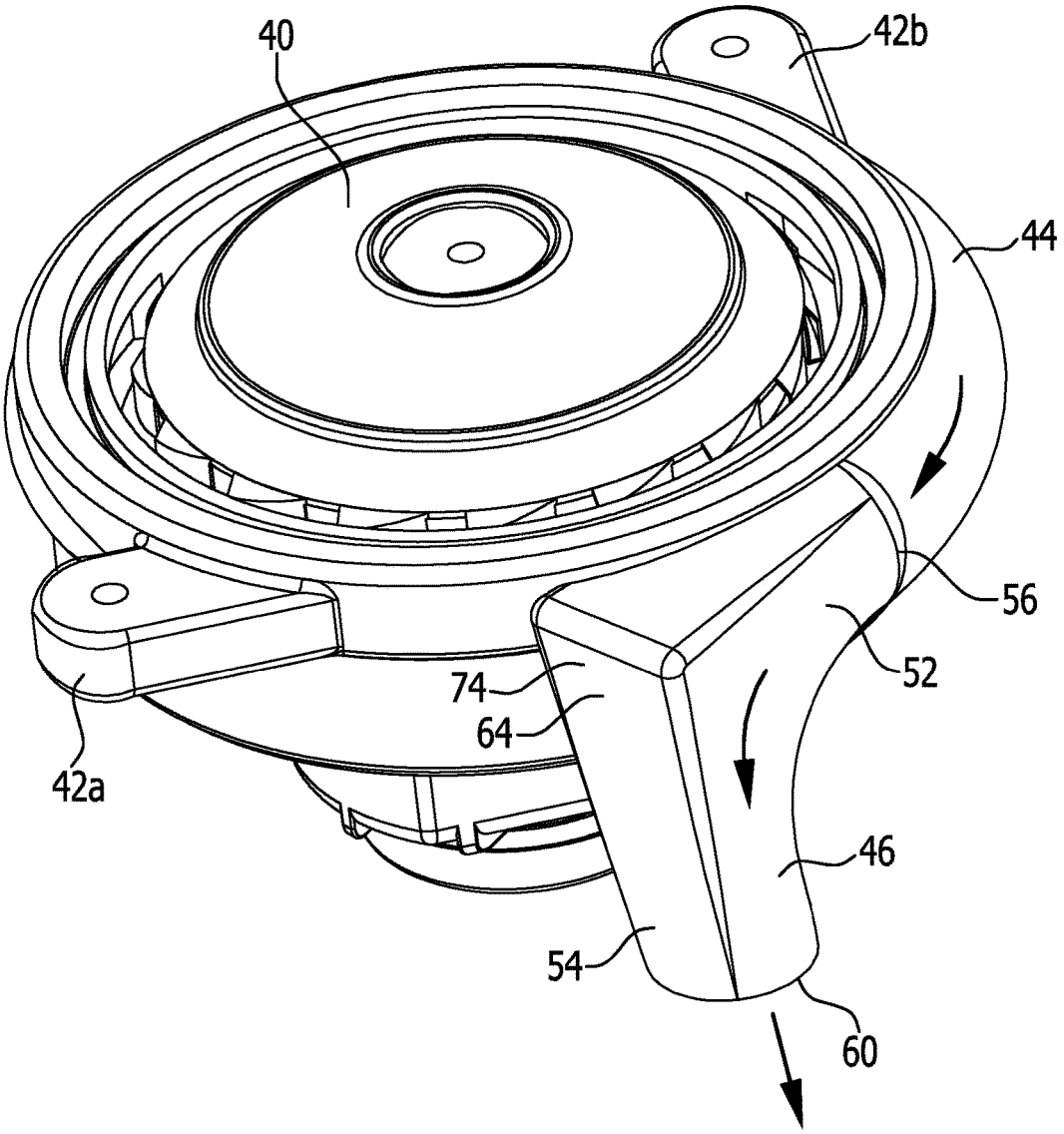
FIG. 3 shows a perspective illustration of an exemplary embodiment of a fan with a bend and a flow deflection element.
Figure 4:
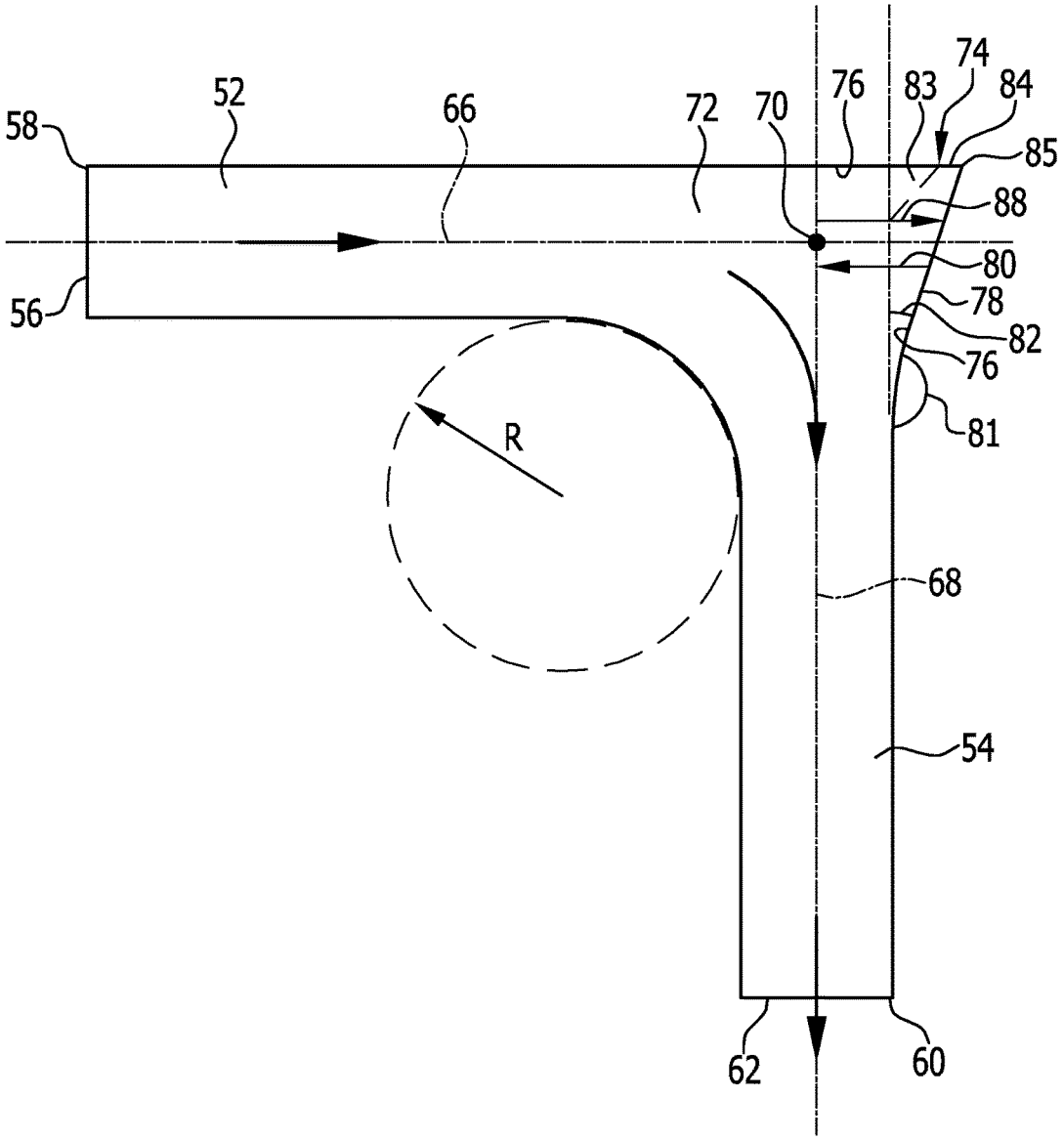
FIG. 4 shows a sectional view of the flow deflection element according to FIG. 3.

The flow deflection element 46 has an inlet tube 52 and an outlet tube 54 (FIGS. 3 and 4). The inlet tube 52 has an inlet 56 with an inlet opening 58. The outlet tube 54 has an outlet 60 with an outlet opening 62.

The flow deflection element 46 may be a part separate from the annular channel 44 and is then connected to the annular channel 44, or may be integrally connected to the annular channel 44.

The outlet 60 may form the housing outlet 48 or is fluidically connected to the housing outlet 48.

In the described exemplary embodiment both sound waves and fluid (suction exhaust air) enter the inlet tube 52, and fluid and (with reduced intensity) sound exit from the outlet 60 of the outlet tube 54. However, it is also possible in principle in other applications that sound is coupled into the inlet tube 52 and is coupled out from the outlet tube 54, and fluid is coupled into the outlet tube 54 and is coupled out from the inlet tube 52.

The flow deflection element 46 has a transitional area 64, which lies between the inlet tube 52 and the outlet tube 54. A flow deflection occurs in the transitional area 64.

A first central longitudinal axis 66 is associated with the inlet tube 52. A second central longitudinal axis 68 is associated with the outlet tube 54. The inlet tube 52 and the outlet tube 54 lie transversely relative to one another in order to achieve a flow deflection. The first central longitudinal axis 66 and the second central longitudinal axis 68 lie transversely relative to one another. In particular, they lie at an acute angle to one another of at least 30°.

In the exemplary embodiment in FIGS. 3 and 4 the inlet tube 52 and the outlet tube 54 lie with their corresponding central longitudinal axes 66, 68 perpendicularly to one another.

The first central longitudinal axis 66 and the second central longitudinal axis 68 intersect one another at a point of intersection 70. This point of intersection lies within an interior 72 of the flow deflection element 46. The point of intersection 70 lies in the transitional area 64.

A sound mirror device 74 is arranged in the transitional area 64. The sound mirror device 74 serves for the at least partial decoupling of the flow flowing through the flow deflection element 46 and of sound waves, in order to attain a noise-reducing effect.

The sound mirror device 74 has a wall structure 76. The wall structure 76 is the transitional wall structure from the inlet tube 52 to the outlet tube 54.

The wall structure 76 here comprises a first wall 78. The first wall 78 is arranged opposite the inlet 56 and is oriented such that a significant proportion of the sound waves are reflected back in the inlet tube 52 by means of the first wall 78 in a direction toward the inlet 56. This is indicated in FIG. 4 by the reference sign 80.

The first wall 78 adjoins the outlet tube 54 and is an extension from the outlet tube 54 in the transitional area 64.

The first wall 78 is substantially flat or has at most a slight curvature.

The first wall 78 lies parallel or at a small acute angle to the inlet opening 58 of the inlet 56.

Figure 5:
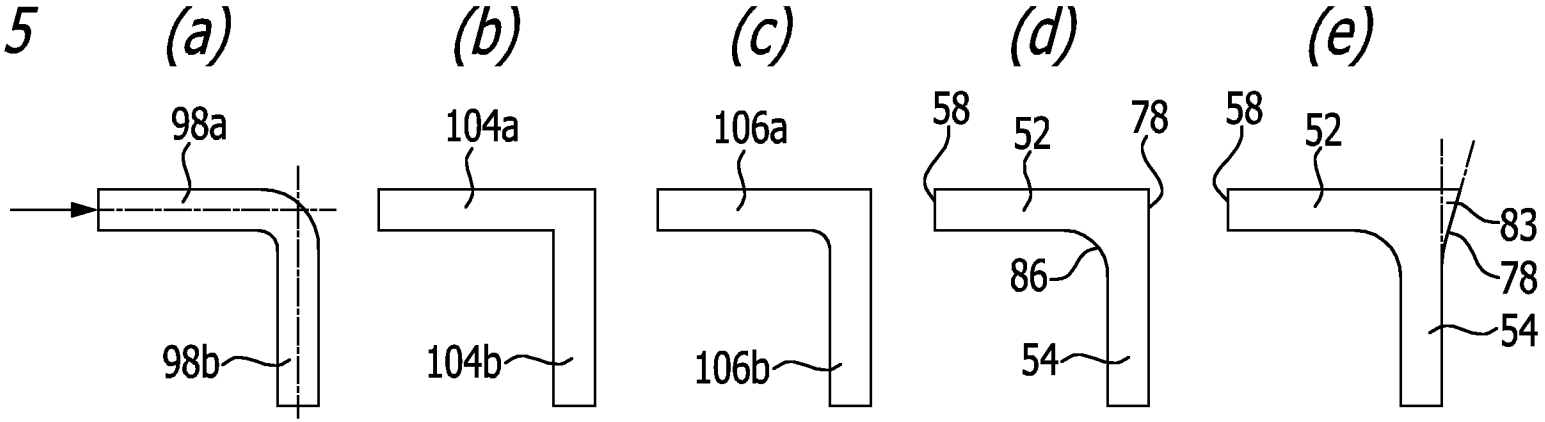
FIGS. 5(*a*) to (*e*) show different shapes for a flow deflection element.

In the exemplary embodiment shown in FIG. 4 (see also FIG. 5(*e*)) the first wall 78 lies at an acute angle 82 to the inlet opening 58 and lies here at an obtuse angle 81, as the supplementary angle to the acute angle 82, to the outlet tube 54. A trough 83 ("sound trough") is thus formed, which allows a sound reflection at the first wall 78 with provision of multiple reflection within the flow deflection element 46.

In one exemplary embodiment the acute angle 82 is approximately 20°. It lies in a range between 10° and 30°, for example.

As shown by way of example in FIG. 5(*d*), it may also be that the first wall lies parallel to the inlet opening 58 or lies parallel (that is to say at an angle of 180°) to the outlet tube 54.

The point of intersection 70 lies between the inlet 56 and the first wall 78; the first wall 78 lies after the point of intersection 70 in relation to the inlet 56 and a corresponding flow direction.

The wall structure 76 also comprises a second wall 84 in the transitional area 64. The second wall 84 adjoins the first wall 78 and is oriented transversely thereto. The second wall 84 then transitions into the inlet tube 52. In particular, the second wall 84 transitions in parallel into the inlet tube 52 and is in particular a parallel continuation of the inlet tube 52 into the transitional area 64.

The second wall 84 is in particular oriented at least approximately parallel to the outlet opening 62 of the outlet 60.

The second wall 84 is in particular flat.

In particular, an edge 85 lies between the second wall 84 and the first wall 78.

The wall structure 76 also has a third wall 86, which is arranged opposite the second wall 84 and there connects the inlet tube 52 to the outlet tube 54.

The third wall 86 is curved in order to minimize a pressure loss in the flow as it flows through the flow element 46.

Here, an inner radius R of the third wall 86 is greater than half the hydraulic diameter of the inner tube 52, in order to achieve a minimization of the pressure loss.

As shown in FIG. 3, a cross-sectional area of the flow deflection element 46, wherein the cross-sectional area lies in particular perpendicularly to the main flow direction, at the sound mirror device 74 and therefore in the transitional area 64 may be greater than in the inlet tube 52 and/or the outlet tube 54 in order to provide an enlarged surface area ("mirror surface") for the sound reflection.

By way of example, the corresponding cross-sectional area, in particular in the transitional area 64, increases toward the first wall 78 starting from the inlet 56 and in particular monotonically and then decreases from the second wall 84 toward the outlet 60 and in particular monotonically.

At the sound mirror device 74 there may be arranged a sound-permeable flow guiding device 88, in particular at or in the vicinity of the first wall 78 and in particular in the trough 83. The flow guiding device 88 has one or more elements which in particular are not permeable for the flow, but which are sound-permeable. A flow deflection may thus be implemented, wherein a sound reflection can occur.

By way of example, the cross-sectional shape of the inlet tube 52 and of the outlet tube 54 may be round (for example circular or oval) or angular.

Figure 7:
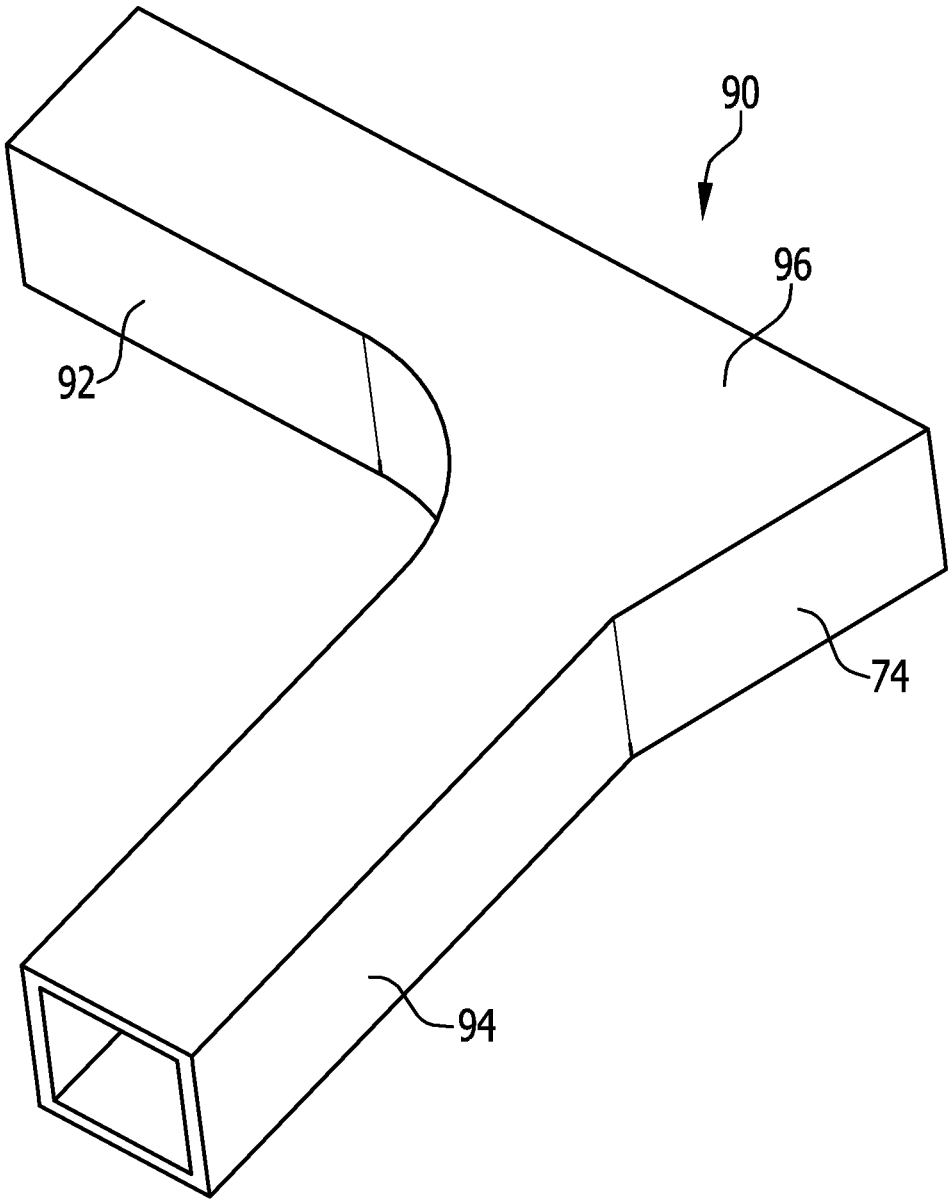
FIG. 7 shows a further exemplary embodiment of a flow deflection element.

An exemplary embodiment of a flow deflection element 90, which has an inlet tube 92 and an outlet tube 94 with square or rectangular cross section, is shown in FIG. 7. A transitional area 96 having a sound mirror device 74 is again arranged between said tubes and in principle functions similarly to the flow element 46.

The suction device 10 according to the invention functions as follows.

Exhaust air and in particular suction exhaust air of the fan device 32 is coupled into the flow deflection element 46 via the annular channel 44 and the inlet 56. The flow is deflected at the flow deflection element 46 in accordance with the orientation of the second central longitudinal axis 68 relative to the first central longitudinal axis 66.

The flow deflection element 46 or 90 is formed here such that a corresponding pressure loss on account of the flow deflection is minimized.

Figure 6:
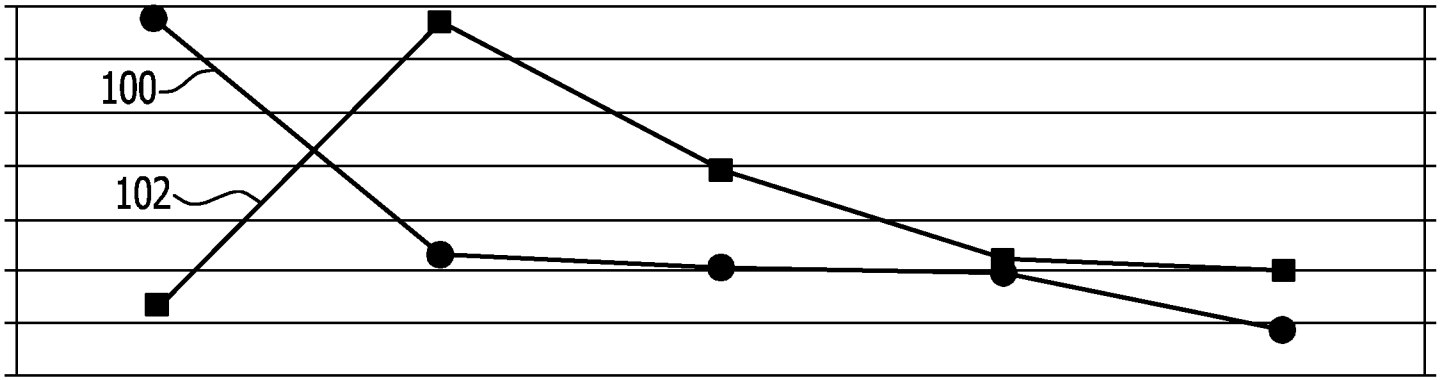
FIG. 6 shows the acoustic transmission losses (circles) and pressure loss coefficients (squares) for an air flow associated with the shapes according to FIG. 5.

This is explained schematically in FIGS. 5 and 6.

FIG. 5(*a*) shows an example of a flow deflection element which is formed as a bent tube having curved transitional areas. A point of intersection of central longitudinal axes of an inlet tube 98*a* and of an outlet tube 98*b* lies on a wall structure of the tube. What is shown in the graph of FIG. 6 is an associated acoustic transmission loss 100 and also an associated pressure loss coefficient 102. The smaller is the acoustic transmission loss 100, the greater is the noise reduction. The smaller is the pressure loss coefficient 102, the lower, naturally, is the pressure loss on account of the flow deflection.

FIG. 5(*b*) shows an embodiment in which an inlet tube 104*a* and an outlet tube 104*b* are arranged perpendicularly to one another and no curved transitional areas are provided.

As can be seen from FIG. 6, a high pressure loss coefficient is provided here, that is to say this embodiment is unfavorable in terms of flow, wherein an improved noise reduction is provided.

FIG. 5(*c*) shows a variant in which an inlet tube 106*a* and an outlet tube 106*b* are arranged on one side perpendicularly to one another without curved transitional area, and opposite this side a curved transitional area is present.

As can be seen from FIG. 6, compared with the form according to FIG. 5(*b*), approximately the same noise reduction is provided, but a reduced pressure loss.

In the embodiment according to FIG. 5(*d*), the third wall 86 having the corresponding curvature is provided as described above (the inner radius is greater than half the hydraulic diameter of the inlet tube 52). The pressure loss is further reduced with approximately the same noise reduction.

The sound mirror device 78 is formed, in which the first wall 78 functions as primary sound mirror, which reflects sound waves, and therefore the reflected sound waves cannot travel in the direction of the outlet 60.

A multiple reflection of sound waves can also occur here, in particular in the transitional region 64.

In the embodiment according to FIG. 5(*e*), which corresponds to the design according to FIG. 4, the first wall 78 lies at an acute angle to the inlet opening 58 of the inlet 56, and a trough 83 is formed. Here, a further noise reduction is provided, as can be seen from FIG. 6, with minimized pressure loss. The first wall 78 still functions as primary sound mirror, wherein sound waves are also reflected for example in the direction of the second wall 84 and are reflected from the second wall 84 for example to the third wall 86. The noise production of the suction device 10 is thus reduced.

With the solution according to the invention comprising the sound mirror device 74 and the third wall 86, there is both an acoustic and a fluidic optimization, wherein the acoustic optimization is decoupled from the fluidic optimization at least to a certain extent. An increased acoustic reflection effect in the flow deflection elements 46 can thus be obtained with relatively low pressure loss in the flow.

A flow deflection element 46 according to the invention has been described in conjunction with the noise reduction of exhaust air of a suction device 10. It is also possible that a corresponding deflection element for noise reduction is used alternatively or additionally in the case of feed air. It is alternatively or additionally also possible that a corresponding flow deflection element is used for the noise reduction in the case of feed air or exhaust air of an air cooling system.

REFERENCE SIGNS LISTING

10 suction device
12 base
14 left rear wheel
16 right rear wheel
18 left front castor
20 right front castor
22 handle unit
24 handgrip
26 suction body
28 housing
30 interior
32 fan device
34 fan
36 connector
38 air conveying device
40 bend
42*a* mounting tab
42*b* mounting tab
44 annular channel
46 flow deflection element
48 housing outlet
50 rear side
52 inlet tube
54 outlet tube
56 inlet
58 inlet opening
60 outlet
62 outlet opening
64 transitional region
66 first central longitudinal axis
68 second central longitudinal axis
70 point of intersection
72 interior
74 sound mirror device
76 wall structure
78 first wall
80 sound reflection
81 obtuse angle
82 acute angle
83 trough
84 second wall
85 edge
86 third wall
88 flow guiding device
90 flow deflection element
92 inlet tube
94 outlet tube
96 transitional area
98*a* inlet tube

98*b* outlet tube
100 acoustic transmission loss
102 pressure loss
104*a* inlet tube
104*b* outlet tube
106*a* inlet tube
106*b* outlet tube

The invention claimed is:

1. A suction device comprising:

a fan device for generating a suction air flow; and an air conveying device having at least one flow deflection element comprising an inlet tube and an outlet tube;

wherein the outlet tube is oriented transversely to the inlet tube;

wherein the inlet tube has a first central longitudinal axis and the outlet tube has a second central longitudinal axis, and wherein the first central longitudinal axis and the second central longitudinal axis intersect one another at a point of intersection;

wherein in a transitional area between the inlet tube and the outlet tube there is arranged a sound mirror device, which at least one of (i) reflects and (ii) absorbs sound;

wherein the point of intersection lies in the transitional area within the at least one flow deflection element;

wherein the mirror sound device has a wall structure that reflects sound;

wherein the wall structure comprises a first wall arranged opposite the inlet;

wherein the wall structure comprises a second wall, which is oriented transversely to the first wall and adjoins the first wall toward the inlet of the inlet tube;

wherein the wall structure has a third wall, which is arranged opposite the first wall and connects the inlet tube to the outlet tube, wherein the third wall is curved; and wherein an inner radius of the third wall is greater than half the hydraulic diameter of the inlet tube.

2. The suction device as claimed in claim 1, wherein at least one of (i) the wall structure is oriented such that a reflection direction is oriented toward an inlet of the inlet tube, and (ii) the wall structure is oriented such that a multiple sound reflection occurs within the at least one flow deflection element.

3. The suction device as claimed in claim 1, wherein a trough is formed in the transitional area by means of the first wall.

4. The suction device as claimed in claim 1, wherein the first wall is flat.

5. The suction device as claimed in claim 1, wherein the first wall is oriented parallel to an inlet opening of the inlet or is oriented at a small acute angle less than 30° relative to the inlet opening.

6. The suction device as claimed in claim 1, wherein the first wall is oriented transversely to an outlet opening of an outlet.

7. The suction device as claimed in claim 1, wherein the first wall lies parallel or at an obtuse angle of at least 150° to the outlet tube.

8. The suction device as claimed in claim 1, wherein the second wall is an extension of the inlet tube to the first wall.

9. The suction device as claimed in claim 1, wherein the second wall is flat.

10. The suction device as claimed in claim 1, wherein a cross-sectional area of the at least one flow deflection element is greater at the sound mirror device than at at least one of an inlet and an outlet.

11. The suction device as claimed in claim 1, wherein a cross-sectional area of the inlet tube increases from an inlet toward the sound mirror device.

12. The suction device as claimed in claim 1, wherein a cross-sectional area of the outlet tube decreases away from the sound mirror device toward an outlet.

13. The suction device as claimed in claim 1, wherein the point of intersection lies between an inlet and the first wall of the sound mirror device.

14. The suction device as claimed in claim 1, wherein the point of intersection lies between the second wall of the sound mirror device and an outlet.

15. The suction device as claimed in claim 1, wherein the first central longitudinal axis and the second central longitudinal axis lie at an angle of at least 30° to one another.

16. The suction device as claimed in claim 15, wherein the first central longitudinal axis and the second central longitudinal axis lie at an angle in the range between 80° and 100° to one another.

17. The suction device as claimed in claim 1, wherein a sound-permeable flow guiding device is arranged on the sound mirror device.

18. The suction device as claimed in claim 1, wherein the at least one flow deflection element is part of a bend.

19. The suction device as claimed in claim 18, wherein the bend surrounds a fan of the fan device.

20. The suction device as claimed in claim 1, wherein the air conveying device is fluidically connected to the fan device.

21. The suction device as claimed in claim 20, wherein the air conveying device is configured at least one of (i) to discharge suction air, (ii) to feed suction air, (iii) to discharge cooling air and (iv) to feed cooling air.

22. The suction device as claimed in claim 1, said suction device being configured as a dry vacuum cleaner, or as a wet vacuum cleaner, or as a wet-dry vacuum cleaner, or as a spray extraction appliance.

23. The suction device as claimed in claim 1, wherein an outlet of the outlet tube is arranged on a housing of the suction device or is fluidically connected to a housing outlet.

* * * * *